US008388259B2

(12) United States Patent
Amengual Pericas

(10) Patent No.: US 8,388,259 B2
(45) Date of Patent: Mar. 5, 2013

(54) MECHANISM FOR ABSORBING KINETIC ENERGY FROM FRONTAL IMPACTS OF VEHICLES

(75) Inventor: Antonio Amengual Pericas, Madrid (ES)

(73) Assignee: Hierros y Aplanaciones, S.A. (HIASA), Corvera (ES)

( * ) Notice: Subject to any disclaimer, the term of this patent is extended or adjusted under 35 U.S.C. 154(b) by 0 days.

(21) Appl. No.: 13/502,515

(22) PCT Filed: Aug. 20, 2010

(86) PCT No.: PCT/ES2010/070565

§ 371 (c)(1),
(2), (4) Date: Apr. 17, 2012

(87) PCT Pub. No.: WO2011/054987

PCT Pub. Date: May 12, 2011

(65) Prior Publication Data

US 2012/0207542 A1 Aug. 16, 2012

(30) Foreign Application Priority Data

Oct. 26, 2009 (ES) ..... 200930907

(51) Int. Cl.
*E01F 15/00* (2006.01)

(52) U.S. Cl. ..... 404/6; 404/10; 188/374; 256/13.1

(58) Field of Classification Search ..... 404/6, 10; 256/1, 13.1; 188/371, 374
See application file for complete search history.

(56) References Cited

U.S. PATENT DOCUMENTS

| | | | | |
|---|---|---|---|---|
| 3,428,150 | A * | 2/1969 | Muspratt et al. | 188/375 |
| 3,779,591 | A * | 12/1973 | Rands | 293/133 |
| 4,823,923 | A * | 4/1989 | Moyer | 188/376 |
| 5,174,421 | A | 12/1992 | Rink et al. | |
| 6,308,809 | B1 * | 10/2001 | Reid et al. | 188/377 |
| 6,457,570 | B2 * | 10/2002 | Reid et al. | 188/377 |
| 6,536,985 | B2 * | 3/2003 | Albritton | 404/6 |
| 6,554,256 | B2 * | 4/2003 | Ochoa | 256/13.1 |
| 7,185,882 | B2 * | 3/2007 | Buth et al. | 256/13.1 |
| 7,325,789 | B2 * | 2/2008 | Buth et al. | 256/13.1 |
| 2003/0034484 | A1 | 2/2003 | Buth et al. | |
| 2005/0036832 | A1 | 2/2005 | Smith et al. | |

FOREIGN PATENT DOCUMENTS

ES 340466 A1 1/1968

OTHER PUBLICATIONS

International Search Report with English translation, mailing date Nov. 30, 2010, for corresponding International Application No. PCT/ES2010/070565.

* cited by examiner

*Primary Examiner* — Gary S Hartmann
(74) *Attorney, Agent, or Firm* — Intellectual Property Law Group LLP

(57) ABSTRACT

A rigid ram, joined to a structural element of a mechanism which receives and transmits the impact of a vehicle, is displaced along a deformable metallic profile of open section in the form of "U", "C", "Σ" or "Ω", the ram having a partial or total intersection with the transversal section of the deformable metallic profile, and producing thereto plastic deformations which are propagated along the deformable metallic profile as the ram is longitudinally displaced along said deformable metallic profile.

7 Claims, 11 Drawing Sheets

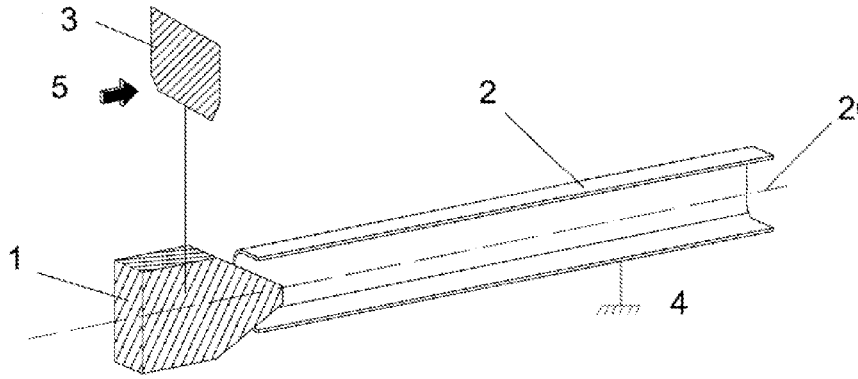
Fig. 1a
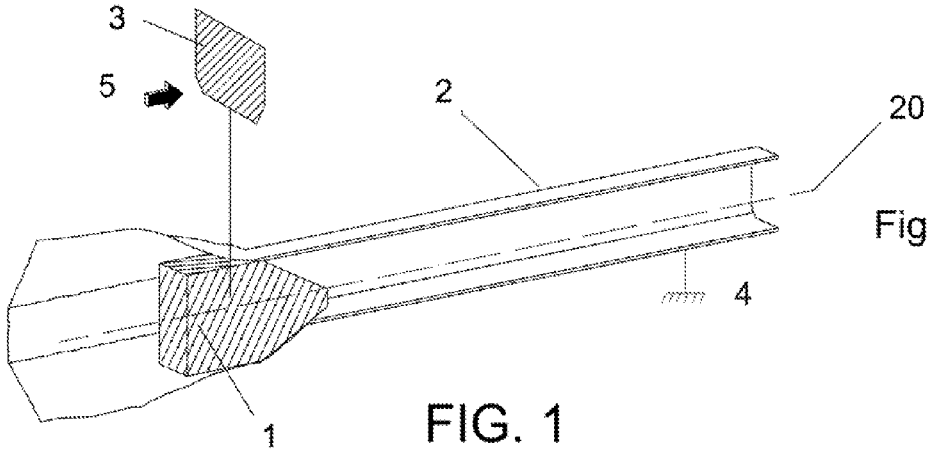
Fig. 1b
FIG. 1

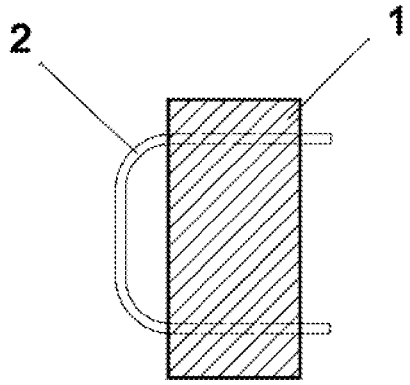
Fig. 2a
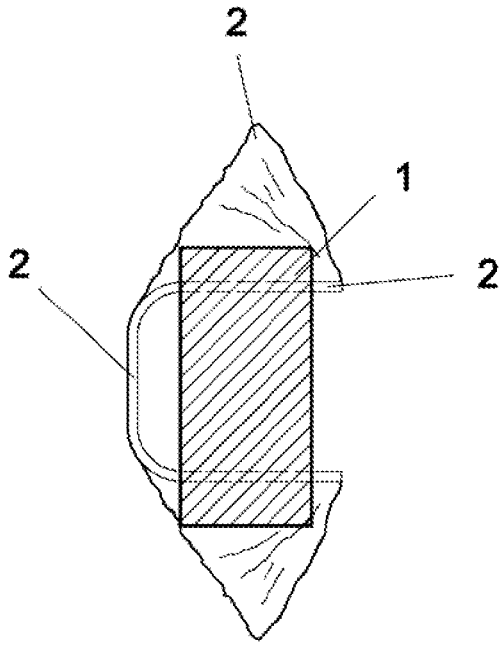
Fig. 2b
FIG. 2

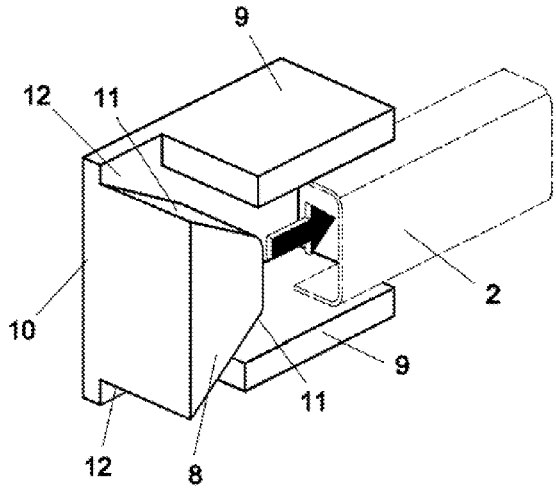
Fig.6a
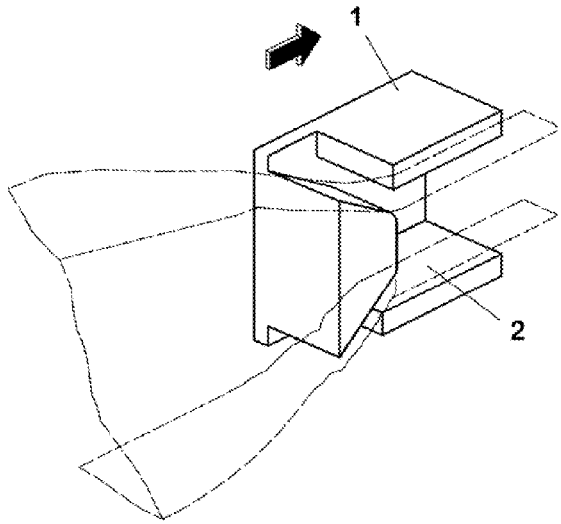
Fig.6b
FIG. 6

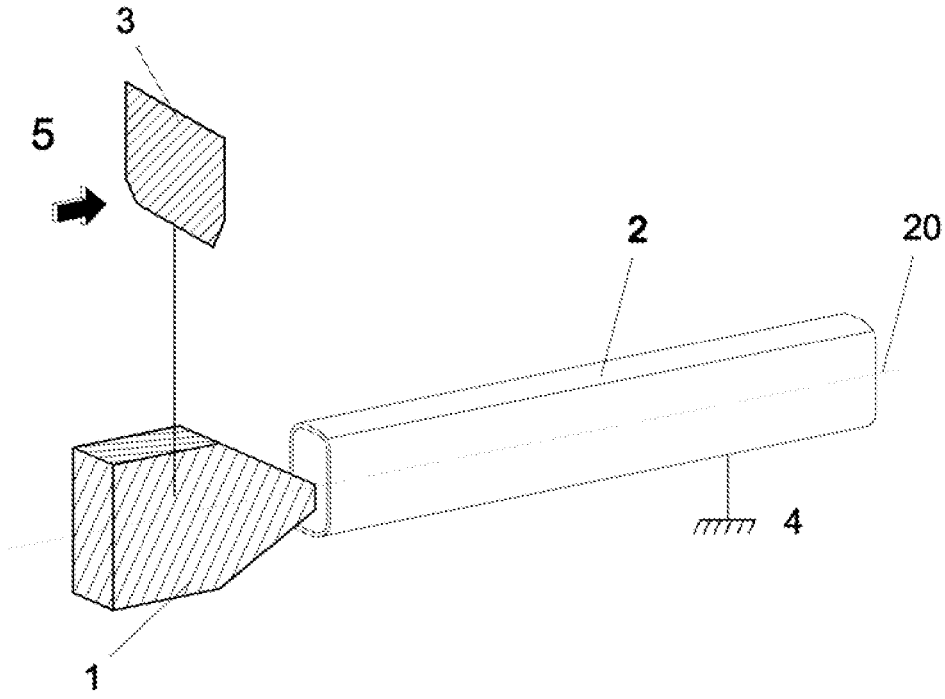
Fig.9a
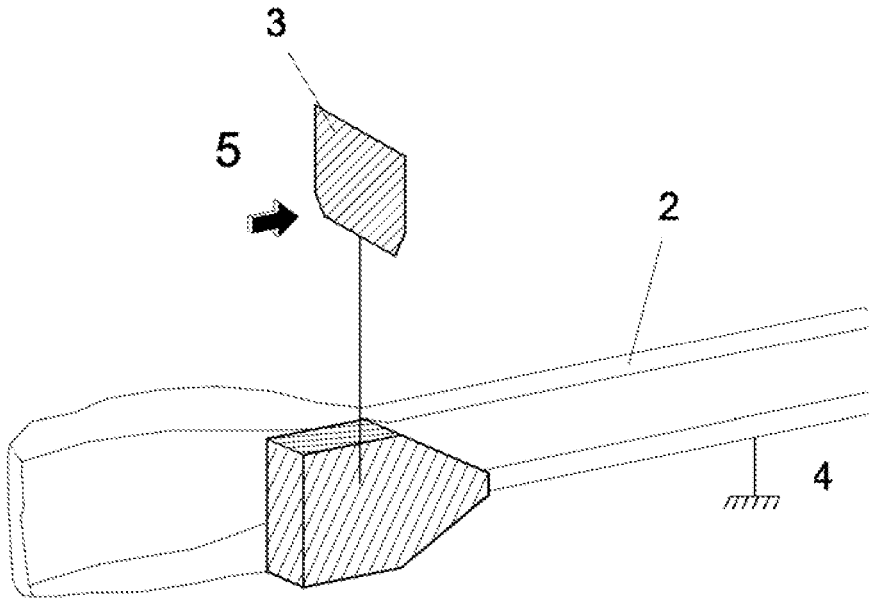
Fig.9b
FIG. 9

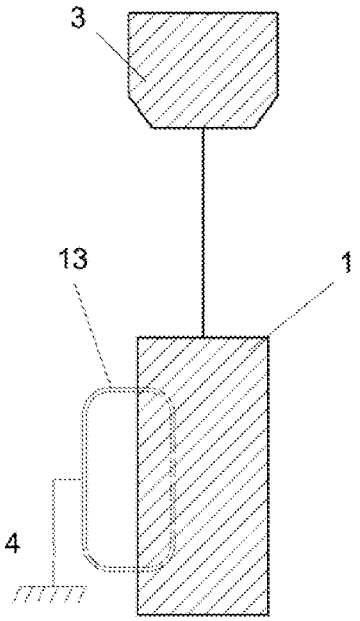
Fig.10a
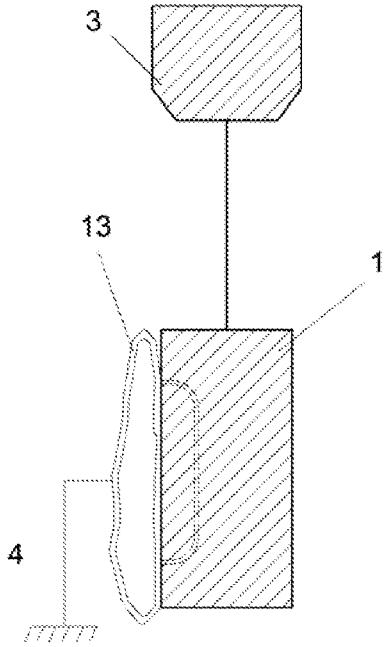
Fig.10b
FIG. 10

MECHANISM FOR ABSORBING KINETIC ENERGY FROM FRONTAL IMPACTS OF VEHICLES

CROSS-REFERENCE TO RELATED APPLICATIONS

This application is a U.S. National Phase application, under 35 U.S.C. §371, of International Application no. PCT/ES2010/070565, with an international filing date of Aug. 20, 2010, and claims benefit of Spanish Application no. P200930907 filed on Oct. 26, 2009, and which are hereby incorporated by reference for all purposes.

OBJECT OF THE INVENTION

The present invention relates to a mechanism for the absorption of the kinetic energy of the frontal impact of a vehicle against a vehicle containment system for use on the sides and central reservations of roads, such as an impact attenuator or a safety barrier terminal, basically comprising of a rigid body by way of an impact element or "ram" and a deformable longitudinal profile, the "ram" being attached directly or indirectly to the structural element of the containment system which receives and transmits the frontal impact of a vehicle to the system and is in turn capable of being displaced longitudinally along it, said "ram" being arranged in the system in such a way that, when it is longitudinally displaced together with the structural element due to the latter receiving the stresses coming from the frontal impact of a vehicle, its cross-section partially or wholly intercepts the cross-section of the deformable metallic profile which is directly or indirectly fixed to the ground and, as a consequence, a plastic deformation is produced in the deformable profile which is longitudinally propagated to the degree that the "ram" is displaced along it.

STATE OF THE ART

There exist in practice different types of vehicle containment systems, these being understood as any device installed on the sides or central reservation of a road with the aim of reducing the severity of the impact from a vehicle which erratically abandons the road and collides against an obstacle, runs down a slope or encounters any other element of risk, replacing the potential impact against the element or risk for a more controlled collision with the system itself, in such a way that limits the injuries and lesions both for the occupants of the vehicle and for other road users as well as other persons or objects in the vicinity.

The most widely used type of containment systems are longitudinal safety barriers whose function it is to provide retention and redirecting of a vehicle which goes out of control and erratically leaves the road, thereby reducing the severity of the accidents produced. The safety barriers are conceived and designed for receiving lateral impacts, in other words, for impact trajectories forming a certain angle (<25°) with the system.

In those locations where vehicles need to be protected from a frontal impact against the obstacle or element of risk on the roadside and such protection cannot be guaranteed with longitudinal barriers, another kind of device is installed known as "impact attenuators" or sometimes also "impact dampers". These devices are positioned between the obstacle and the road with the aim of reducing the severity of the frontal impact of the vehicle against the obstacle and, to do this, they function by absorbing part or all of the energy of the impact by means of a suitable mechanism which acts to the degree that it is longitudinally deformed, in the manner of an "accordion". As all impact attenuators usually have a certain initial length, frequently exposed to the traffic, so they need to behave like safety barriers in the event of a possible lateral impact. For that reason, impact attenuators displaying the capacity to laterally contain impacts are known as "redirecting". Most of the applications of this type of systems requires "redirecting" attenuators.

There exist mobile impact attenuators which are mounted on a heavy vehicle or similar moving truck and which, once the vehicle halts and protects an area in the front, the mobile attenuator is placed in position behind the heavy vehicle in order to reduce the severity of the frontal impact of other vehicles which might collide against the stationary heavy vehicle. This type of mobile impact attenuators, known as Truck Mounted Attenuators (TMA), are usually used for protecting areas of works on a road.

Another kind of containment system that has to protect vehicles against frontal impacts by them are barrier terminals with energy absorption ("TAE"). These devices are specific terminations for longitudinal sections of safety barriers at their ends, which protect the vehicle from frontal impact against the termination of the actual barrier (which is designed for lateral impacts only) thereby reducing the severity of the impact. As with impact attenuators, "TAE" function by means of a mechanism for absorbing kinetic energy which acts to the degree that the vehicle longitudinally deforms the "TAE" until it comes to a complete halt.

There currently exist various models of impact attenuator depending on the mechanism for absorbing kinetic energy used in each case: blocks or boxes of plastic materials, foam, airbags, sets of aluminium tubes, and so on, arranged between metallic frames which, in the event of a frontal impact from the vehicle, are displaced longitudinally along the attenuator "compressing" those boxes, filled drums, vertical axis cylinders manufactured in steel or using elastomeric plastic materials, grooved steel hoops longitudinally arranged between profiles which are "cut" by knives that are displaced as a consequence of the impact from the vehicle, etc.

The use of one or another mechanism for absorbing kinetic energy in a containment system, according to its material composition, configuration and manner of functioning, determines:

- The controlled efficiency of the energy absorption and the minimum length of the system. In theory, any mechanism that is capable of absorbing more kinetic energy per unit of length would be regarded as more efficient, since this would allow a system with shorter length, lower cost and better adaptation to the available space for a defined impact kinetic energy. However, deceleration of the vehicle until it comes to a halt has to be achieved within certain maximum limits since there would otherwise exist the risk of injuries being caused to the occupants of the vehicle and, moreover, the resulting degree of deformation of the vehicle must not be such that it affects the passenger compartment. The energy absorption mechanism must, on the one hand, be as efficient as possible and, on the other, it must be sufficiently controlled so that the maximum admissible deceleration values are at no time exceeded nor are any excessive deformations produced in the vehicle.
- Durability. The mechanism must comprise materials and be designed in such a way that guarantees a reasonable useful life, in other words, a period of time in which it maintains its features in the event of impact from vehicles. Plastics, foams, etc., do not usually guarantee a sufficiently long useful life compared to the durability of the safety barriers that are manufactured in galvanized steel or they do not offer a stable behaviour in time, as in the case of airbags and some plastic or foam materials. Only those systems manufactured entirely from galvanized steel can guarantee durabilities similar to those of metal barrier.

Economic cost. The efficiency of the absorption system in this type of containment systems has to be achieved at a reasonable cost. The use of excessively costly materials, such as the "honeycomb panel" made of aluminium or certain foams, leads to very expensive systems, reducing their cost/benefit ratio which is fundamental for their application in road safety. The energy absorption mechanism of such systems has to be manufactured in a material and designed such that its cost is kept within a reasonable range. Galvanized steel is a common and economical material, always provided the design of the system is not complex since the economics of the material would otherwise suffer from high manufacturing costs.

Repair facility. Impact attenuators are usually high-cost devices in comparison with other containment systems. They are therefore normally designed so that they can resist more than one vehicle impact without having to replace the entire system. In this regard, the energy absorption mechanism must be easy and economical to repair following an impact so that the attenuator can be reused in the greatest possible proportion. This not only reduces the operating costs of the system, it also contributes to environmental sustainability.

The current state of the art offers different and varied solutions for the absorption of kinetic energy from the frontal impact of a vehicle against a containment system but none of them presents certain optimum features according each of the determining factors stated above.

DESCRIPTION OF THE INVENTION

The present invention provides a new mechanism for the absorption of kinetic energy from the frontal impact of a vehicle against a containment system which, incorporating a containment system for vehicles such as an impact attenuator or a barrier terminal, has advantages with respect to the present state of the art in that it optimizes the features of the system in terms of:

1. Better controlled performance and efficiency of energy absorption along the length of the system.
2. Total stability of functioning over time.
3. Greater durability.
4. Lower economic cost.
5. Greater ease of repair and better reutilization.

This new mechanism for the absorption of kinetic energy from the frontal impact of a vehicle against a containment system such as an impact attenuator or barrier terminal basically comprises two interrelated elements as shown in FIG. 1, sub-FIG. 1*a*.

Rigid body by way of an impact element or ram (1)

Deformable metallic profile (2) arranged longitudinally in the containment system, which are arranged in the system in such a way that the transverse cross-section of the ram (1) interferes wholly or partially with the transverse cross-section of the deformable profile (2), as shown in FIG. 2, sub-FIG. 2*a*.

The ram (1) is rigidly joined, directly or indirectly, with suitable means of attachment to a structural element (3) of the containment system that is capable of being longitudinally displaced as a consequence of the frontal impact of a vehicle against the frontal part, in other words, the part of the containment system closest to the incident traffic, as shown in FIG. 1, sub-FIG. 1*a*. This structural element (3) is located and fitted to the containment system in such a way that it is capable of directly or indirectly receiving the frontal impact of the vehicle (5) and transmitting it to the ram (1). The ram (1) and the structural element (3) described above form part of the moving part of the containment system, in other words, the part of the system that is longitudinally displaced during the frontal impact (5) of a vehicle.

The deformable profile (2) is rigidly joined, directly or indirectly, by means of suitable means of attachment to the ground (4) and it therefore forms part of the static part of the containment system, in other words, the part of the system that does not move during the frontal impact (5) of a vehicle.

In this way, when a vehicle impacts frontally against the containment system and produces the longitudinal displacement of the structural element (3) towards the rear part of the system, the ram (1) that is attached to this experiences the same displacement in the longitudinal direction, which is parallel to the axis (20) of the deformable profile (2). Since the transverse arrangement of the two elements (1) and (2) is such that the cross-section of the ram (1) partially or wholly intercepts the cross-section of the deformable profile (2), so the ram (1), when it is longitudinally displaced, causes a plastic deformation to one, several or all of the faces of the deformable profile to the degree that it advances along it, as shown in FIG. 1, sub-FIG. 1*b* and FIG. 2, sub-FIG. 2*b*. The progressive plastic deformation of the deformable metallic profile (2) produced by the passage of the ram (1) which advances along it, intercepting it, absorbs or consumes the kinetic energy of the vehicle until it comes to a complete halt. So, this mechanism forms by the combination of a ram (1) and a deformable profile (2) converts the frontal kinetic energy of the impact of a vehicle against the containment system into a plastic deformation of the profile, once that energy has been transmitted to the ram (1).

So that the unit formed by the ram (1) and the structural element (3) of the system can be displaced longitudinally along it and thereby achieve the deformation of the profile (2) by interception with the ram (1), the ram (1) and the structural element (3) need to be displaced just longitudinally without doing so in other directions. One solution for achieving this comprises of providing a longitudinal guide profile (6), as shown in FIG. 3, which is not deformable by the ram and is rigidly attached or secured to the ground (4), in such a way that both the structural element (3) and the ram (1) use it as a guide in the manner of a support or runner. This longitudinal guide profile (6) forms part of the static part of the containment system.

The mechanism is simplified if, moreover, the deformable profile (2) is rigidly fixed with suitable means of attachment (7) to the guide profile (6), as shown in FIG. 4. The same guide profile (6) can have two or more deformable profiles (2) fixed to it, as shown in FIG. 5. In this latter case, the structural element (3) of the system is provided with one, two or several rams (1) each corresponding to one of the deformable profiles (2).

In order to achieve the desired level of energy absorption as well as a deceleration control suited to the magnitude of the design frontal impact, two or more longitudinal guide profiles (6) can be provided, parallel and close to each other, and rigidly secured to the ground (4) by suitable means (15) and preferably connected together, on which the deformable profiles (2) are fitted, using one, two or more profiles (2) in each guide profile (6), as shown in FIG. 11.

The ram (1) can have different geometries depending on the deformation work of the profile that is expected of it and of the actual cross-section of the deformable profile (2). With the aim of the attack of the ram (1) against the profile (2) being as efficient and controlled as possible, the ram (1) preferably has its forward part (taken in the direction of advance of the impact) in the form of a wedge, as can been seen in FIG. 1.

The deformable profile (2) can in turn comprise of two or more sections (2') (2") arranged longitudinally one after the other, as shown in FIG. 7. The dimensions of some of the faces of the cross-section of the profile (2) along with its thickness can vary from one section (2') to another (2"). With this, the resistance of the profile (2) to the passage of the ram (1) manages to be varied on a modular basis thereby controlling the decelerations produced in the vehicle due to the reaction of the mechanism for absorbing the energy in that vehicle, as well as the amount of energy consumed per unit of length. The larger the dimension of the faces and the greater the thickness, the greater the resistance to the passage of the ram. At each instant, the resistance of the mechanism has to be adjusted to the changes of speed that it is wished to achieve in the vehicle. Therefore, in the first instants of the impact which corresponds of course to the greatest speed of the vehicle, it is advisable for the resistance to be low or even zero in order not to cause any sudden jumps, and to increase the resistance as the vehicle is brought to a halt. The decomposition of the deformable profile (2) into sections of different cross-section or thickness (2') (2") is fundamental for achieving the controlled functioning of the absorption mechanism.

Given that, in the first moments of the frontal impact of a vehicle against a containment system, the decelerations produced on the vehicle must in particular be controlled since this is when the speeds are greatest, and all the more so if it is borne in mind that in these first instants the vehicle has to set into motion the moving masses of the system, it is therefore advisable that the resistance of the deformable profile (2) to the passage of the ram (1) should be minimal or zero at these first instants. To achieve this, a section of deformable profile (2''') is provided with one or more faces whose dimension increases from a minimum or zero length until achieving the constant value of the cross-section of the profile, as shown in FIG. 8.

The deformable profile (2) can be open or closed and can also have different shapes of cross-section.

When an open profile is used with a cross-section in the form of a "U", "C", "sigma" or "omega", the ram (1) attacks the profile mostly via the open part, deforming and opening out part or all of the faces (wings and flanges) other than the core or ridge of the profile. When an open profile is used with a "double wave" or "triple wave" cross-section any part of the profile can be attacked by the ram, either opening it out or folding or crushing it one against the other.

FIG. 6, with its sub-FIGS. 6*a* and 6*b*, shows a very efficient configuration of the ram (1) when the deformable profile (2) has an open cross-section in the form of a "U", "C", "sigma" or "omega". The ram (1) comprises of a base plate (10) by way of support for a core (8) with the forward part (in the direction of advance) having the form of a wedge and with two wings (9) in their upper and lower ends, which do not cover the entire length of the ram (1), with two openings (12) remaining in the rear part thereof. The height of the core or ridge of the deformable profile (2) with open cross-section is greater than the height of the wedge-shaped front part of the core (8) of the ram (1) but less than the distance between the wings (9) of the ram and less, in turn, than the height of the rear part of said core (8) in such a way that, as the system has the ram (1) with its base (10) facing the ridge of the deformable profile (2) and, to the degree that the ram (1) is longitudinally displaced along the deformable profile (2), the wedge-shaped attack surfaces (11) of the core (8) of the ram (1) force the wings of the deformable profile (2) to open and spread out, being plastically deformed and with both wings of the profile (2) projecting through the openings (12) of the rear part of the ram (1).

When a deformable profile of closed or tubular cross-section (13) is used, or a profile with a closed or tubular part, as shown in FIGS. 9 and 10, the ram (1) is longitudinally displaced along the profile (13) parallel to its axis (20) and the plastic deformation of the latter is produced by the crushing of part or all of the closed cross-section.

BRIEF DESCRIPTION OF THE DRAWINGS

In order to complement the description being made and with the aim of aiding a better understanding of the characteristics of the invention, in accordance with a preferred example of a practical embodiment thereof, attached as an integral part of this description is a set of drawings in which, on an illustrative basis without being limiting, the following has been represented:

FIG. 1 shows a lateral perspective view of the unit formed by the rigid impact body or "ram" and a deformable longitudinal profile fixed to the ground.

FIG. 2 shows a transverse cross-section of the unit formed by the rigid impact body or "ram" and the deformable longitudinal profile, prior to receiving and transmitting the impact (FIG. 2*a*) and during the longitudinal displacement of the "ram" (FIG. 2*b*).

FIG. 6 shows the three-dimensional image in perspective of a rigid impact body or "ram" in the form of a wedge and two end wings (FIG. 6*a*) and and the profile deformed as the "ram" is displaced along the deformable profile (FIG. 6*b*).

FIG. 9 shows a lateral perspective view of the unit formed by the rigid impact body or "ram" integrally joined to a structural element of the containment system intended to receive directly or indirectly the frontal impact of a vehicle and a closed deformable longitudinal profile fixed to the ground, prior to receiving and transmitting the impact of the vehicle (FIG. 9*a*) and during the longitudinal displacement of the "ram" parallel to the axis of the closed deformable profile, deforming it in its passage by crushing (FIG. 9*b*).

FIG. 10 shows a transverse cross-section of the unit formed by the rigid impact body or "ram" and the closed deformable longitudinal profile, prior to receiving and transmitting the impact of the vehicle (FIG. 10*a*) and during the longitudinal displacement of the "ram" parallel to the axis of the closed deformable profile, deforming it by crushing it in its passage (FIG. 10*b*).

DESCRIPTION OF AN EXAMPLE EMBODIMENT OF THE INVENTION

Figure 3:
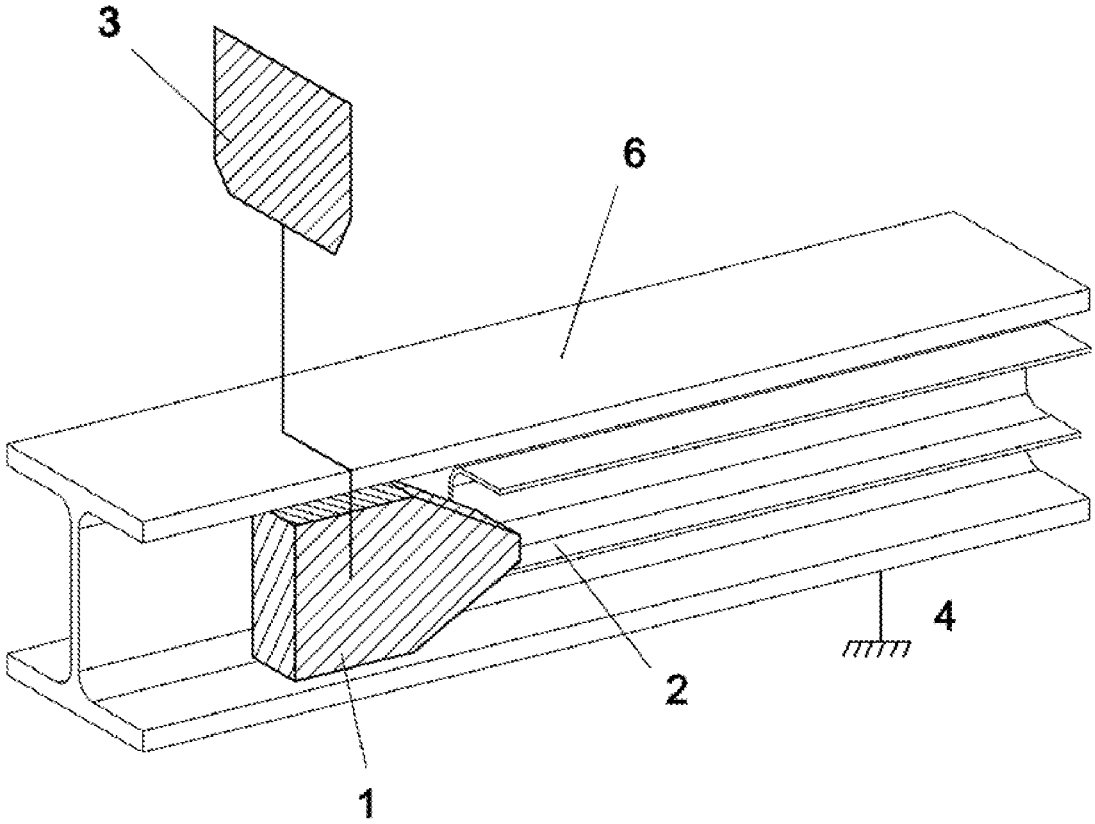
FIG. 3 corresponds to a lateral perspective view of a section of the longitudinal guide profile, and of the structural element and "ram".
Figure 4:
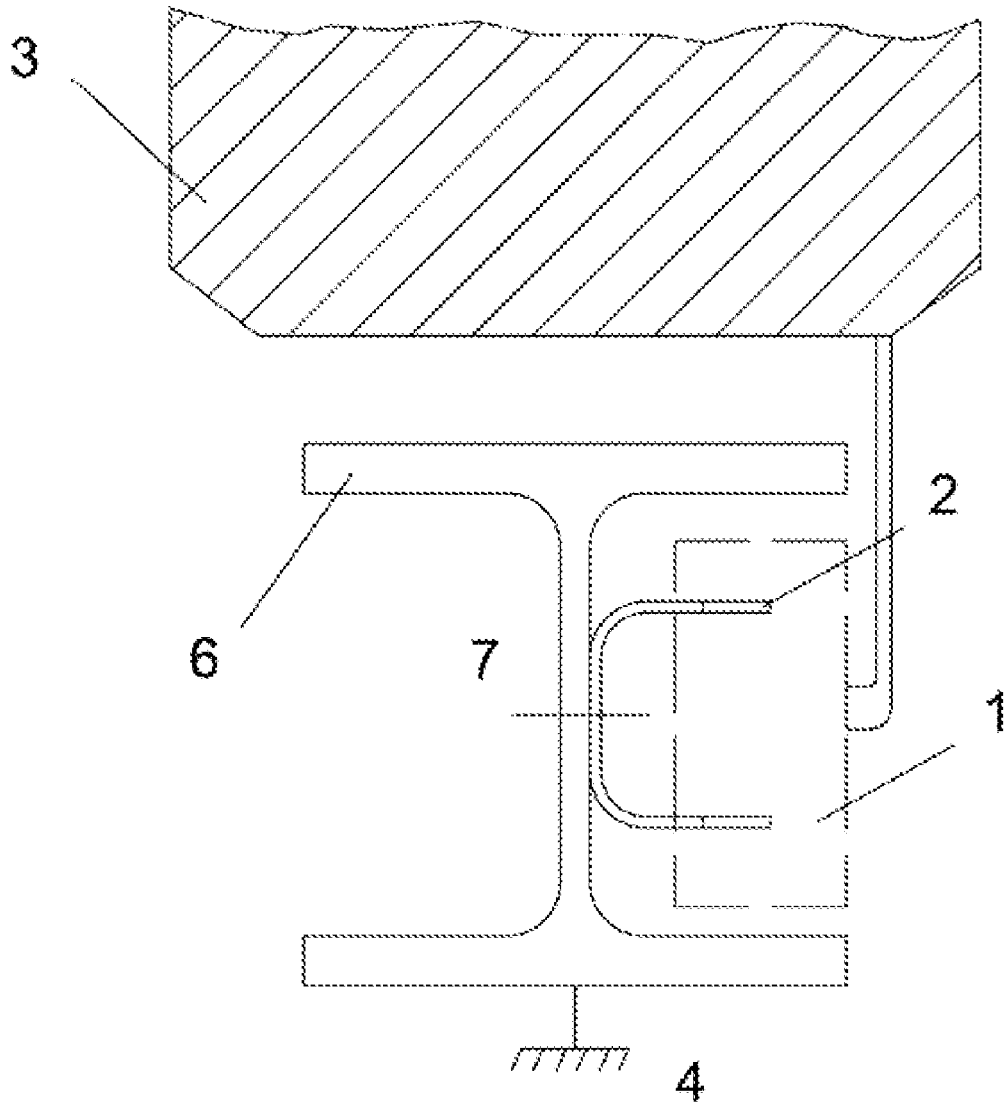
FIG. 4 shows a transverse cross-section with the guide profile with cross-section in the form of an "H", the deformable profile, and the "ram" (1).
Figure 5:
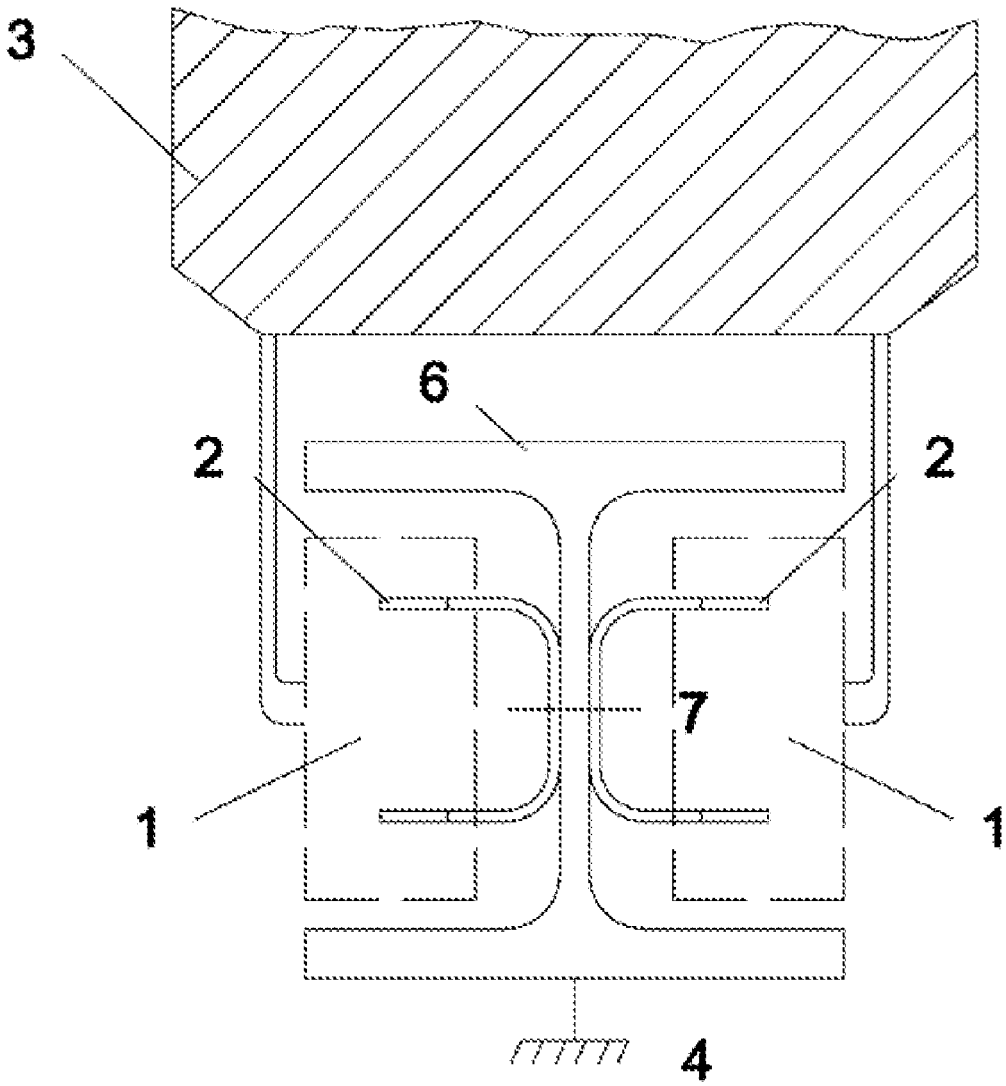
FIG. 5 shows a transverse cross-section with the same guide profile with cross-section in the form of an "H" and two deformable profiles and two "rams".
Figure 7:
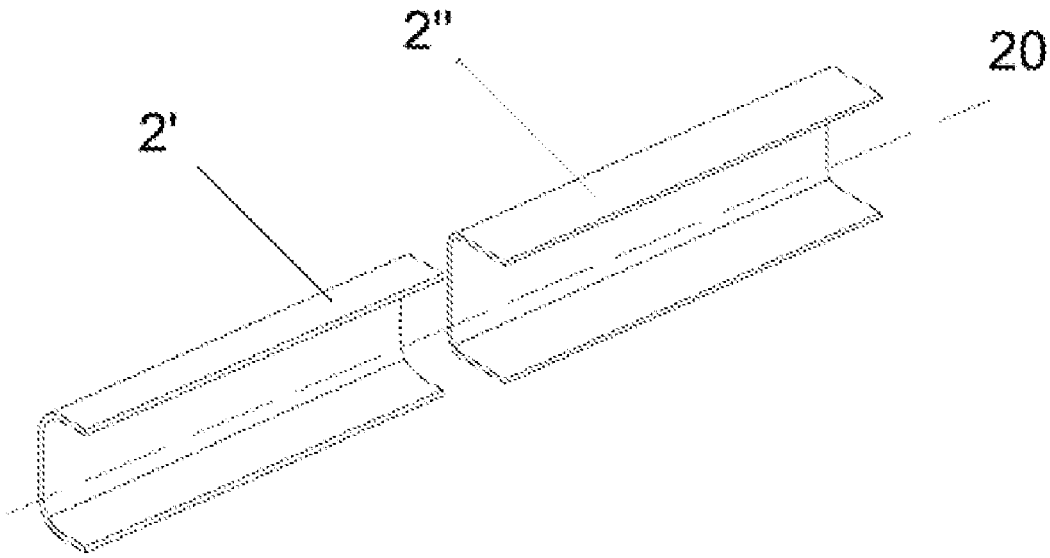
FIG. 7 shows a lateral perspective view of a deformable profile consisting of two consecutive sections.
Figure 8:
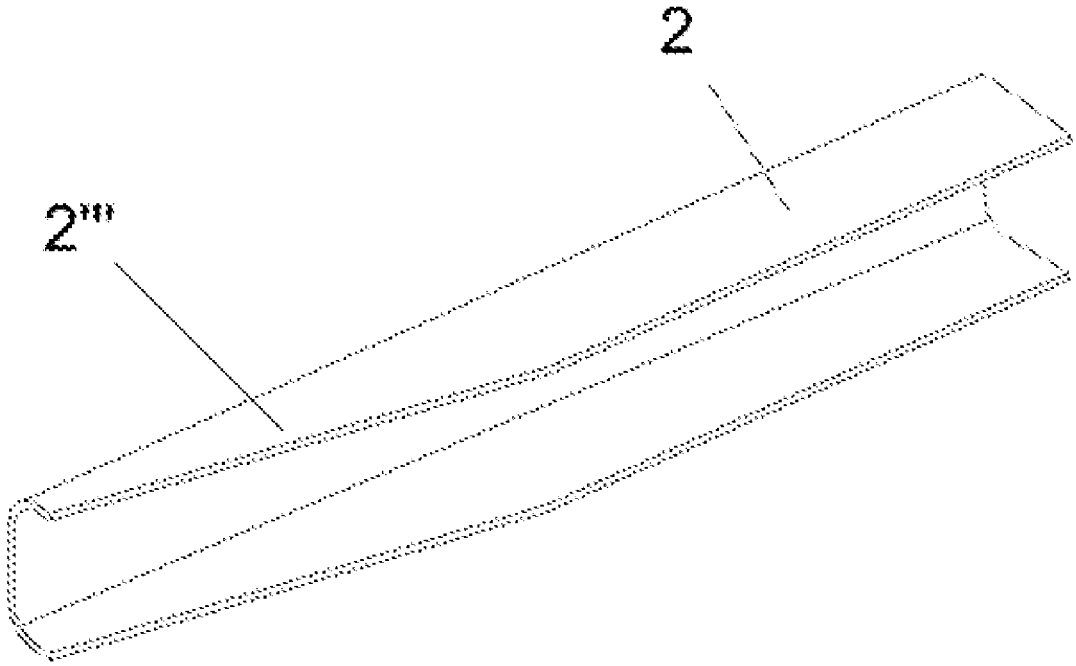
FIG. 8 shows a lateral perspective view of a deformable profile in which the dimension of one or more of its parts progressively increase along the profile until reaching a constant value.
Figure 11:
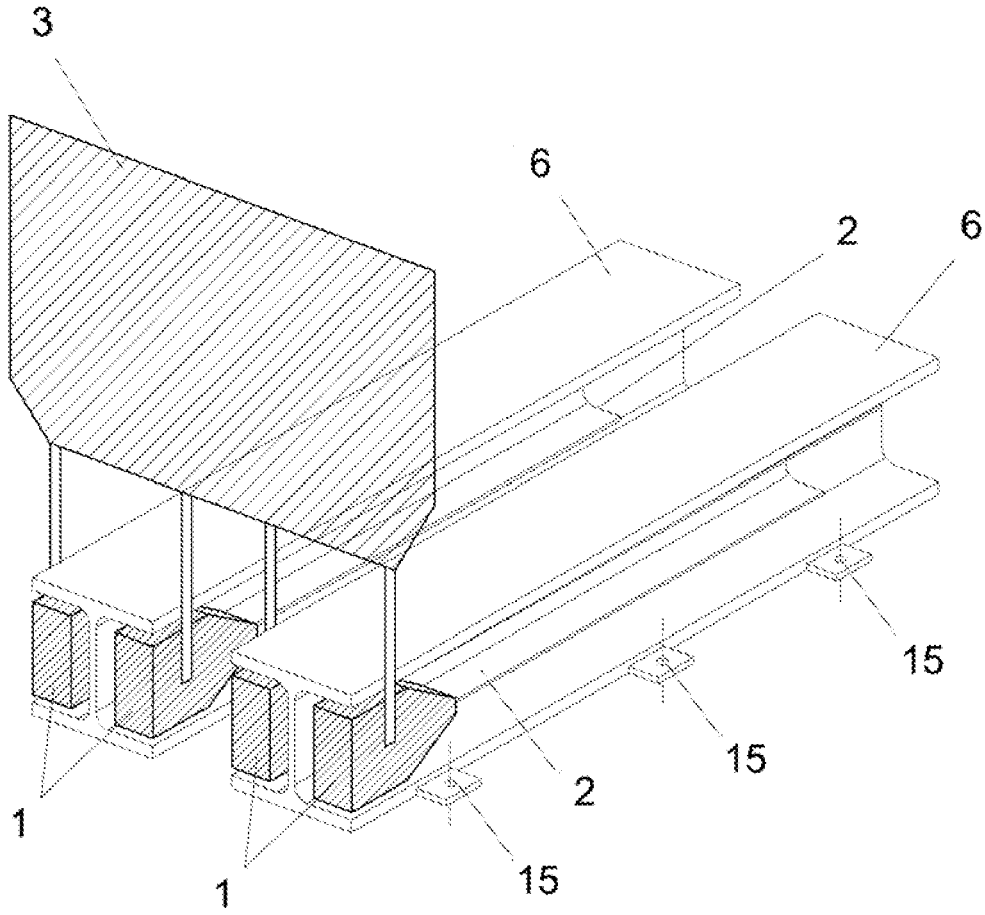
FIG. 11 shows a lateral perspective view of the unit formed by two equal longitudinal guide profiles with cross-section in the form of an "H", with two open deformable profiles each in the form of a "U", arranged in both throats of the cross-section of the "H" guide profile.

FIGS. 6, 7, 8 and 11 show a particular embodiment of the present invention comprising of a mechanism for the absorption of the kinetic energy of a vehicle impacting frontally against a containment system such as an impact attenuator, the base of which is formed by two longitudinal guide profiles (6) of identical cross-section in the form of an "H", arranged parallel and very close to each other, connected together and secured to the ground (4) by suitable anchor bolts (15).

Fixed centrally to the core of each guide profile (6) by adequate means of attachment (7) are two deformable profiles (2) open in cross-section in the form of a "U", arranged symmetrically one in each throat of the "H" shaped cross-section.

Each one of the deformable profiles (2) with cross-section in the form of a "U" is in turn made up of several sections (2') (2") with an identical "U" shaped cross-section but of different thickness, with increasing thicknesses in the direction of the impact. The first sections of each "U" shaped deformable profile (2), understanding as such the first to be attacked by the ram (1) during the frontal impact of a vehicle (5) against the attenuator, have their wings reduced in the initial section (2'") in such a way that the length of each of the wings of the "U" shaped profile increase in that section, until reaching the length of wing that corresponds to the cross-section of said "U" shaped profile of the consecutive sections.

The attenuator has a structural element (3) by way of a frame, arranged vertically and perpendicular to the base formed by the guide profiles (6) and joined rigidly to four rams (1), capable of being longitudinally displaced along the guide profiles (6) sliding as if the latter were runners, supported on them and being connected to them by means of a suitable guiding system, with the four rams (1) joined to the element (3) and arranged in the four throats of the guide profiles (6) in such a way that, when each ram (1) advances in the direction of the frontal impact of a vehicle against the structural element (3), each ram (1) intercepts the deformable profile (2) located in the same throat.

The four rams (1) present a very similar configuration. Each ram (1) comprises of a base plate (10) by way of support for a core (8) with the forward part in the form of a wedge and with two wings (9) in its ends, upper and lower, which do not cover the entire length of the ram (1), there remaining two openings (12) in the rear part thereof. The height of the core of the deformable profile (2) with a "U" shaped cross-section is greater than the height of the wedge-shaped front part (in the direction of advance) of the core (8) of the ram (1) but less than the distance between the wings (9) of the ram and less, in turn, than the height of the rear part of said core (8) in such a way that, as the system has the ram (1) with its base (10) facing the open part of the "U" shaped cross-section of the deformable profile (2) and, to the degree that the ram (1) is longitudinally displaced along the deformable profile (2), the wedge-shaped attack surfaces (11) of the core (8) of the ram (1) force the wings of the deformable profile (2) to open and spread out, being plastically deformed and with both wings of the profile (2) projecting through the openings (12) of the rear part of the ram (1).

What is claimed is:

1. A mechanism for absorbing kinetic energy in shock absorbers and barrier ends for roadways, comprising;

a deformable metallic profile (2) of open section in the form of a "U", "C", "Σ" or "Ω", being directly or indirectly secured to the ground (4), a ram (1), being attached directly or indirectly to a structural element which is capable of being displaced longitudinally, as a consequence of an impact of a vehicle (5), the ram (1) having a partial or total intersection with a transversal section of the deformable metallic profile (2), and capable of producing thereto plastic deformations which are propagated along the deformable metallic profile (2), as the ram (1) is longitudinally displaced along said deformable metallic profile (2).

2. The mechanism for absorbing kinetic energy in shock absorbers and barrier ends for roadways, according to claim 1, characterized in that the ram (1) comprises;

a base plate (10), a core (8), joined to the base plate (10), whose forward part has the form of a wedge with two attack surfaces (11), two wings (9), joined to the upper and lower part of the base plate (10), in front of the core (8), leaving two openings on said base plate (12), and embracing the metallic deformable profile (2), being the height of the core of the deformable metallic profile (2) higher than the height of the wedge-formed part of the core (8) of the ram (1), but less than the back part of said core (8).

3. The mechanism for absorbing kinetic energy in shock absorbers and barrier ends for roadways, according to claim 1, characterized in that the deformable metallic profile (2) shows, along a part or a whole length of said deformable metallic profile (2), one or several faces whose length increases progressively until it reaches a constant value.

4. The mechanism for absorbing kinetic energy in shock absorbers and barrier ends for roadways, according to claim 1, characterized in that the deformable metallic profile (2) consists of two or more consecutive sections, arranged longitudinally one after the other, which can, with respect to each other, have a different dimension for one or more of the parts or faces forming their cross-section, or have different thickness.

5. The mechanism for absorbing kinetic energy in shock absorbers and barrier ends for roadways, according to claim 1, characterized in that the deformable metallic profile (2), is rigidly attached to a metallic guide profile (6), set up with its longitudinal axis (20) parallel to the deformable metallic profile (2), and said guide profile (6) directly or indirectly secured to the ground (4).

6. The mechanism for absorbing kinetic energy in shock absorbers and barrier ends for roadways, according to claim 5, characterized in that two or more deformable metallic (2) profiles are attached to the same guide profile (6).

7. The mechanism for absorbing kinetic energy in shock absorbers and barrier ends for roadways, according to claim 5, characterized in that the guide profile (6) having a section in the form of "H", "U", "C", "Ω" or "Σ", with the deformable metallic profile (2) is attached to the core of the guide profile (6); in such a way that the ram (1) as well as the deformable metallic profile (2) remain, totally or partially, located in the throat of the guide profile (6).

* * * * *